US010759164B2

(12) United States Patent
Sukenori et al.

(10) Patent No.: US 10,759,164 B2
(45) Date of Patent: Sep. 1, 2020

(54) APPLICATION DEVICE, INK APPLICATION METHOD, AND NON-TRANSITORY RECORDING MEDIUM

(71) Applicant: CASIO COMPUTER CO., LTD., Tokyo (JP)

(72) Inventors: Atsushi Sukenori, Higashiyamato (JP); Shota Nakahara, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 7 days.

(21) Appl. No.: 16/258,999

(22) Filed: Jan. 28, 2019

(65) Prior Publication Data

US 2019/0232650 A1 Aug. 1, 2019

(30) Foreign Application Priority Data

Jan. 29, 2018 (JP) ..... 2018-012964

(51) Int. Cl.

| | |
|---|---|
| ***B41J 2/125*** | (2006.01) |
| ***B41J 2/045*** | (2006.01) |
| ***B41J 11/00*** | (2006.01) |
| ***B41J 29/02*** | (2006.01) |
| ***B41J 3/36*** | (2006.01) |

(52) U.S. Cl.

CPC ..... *B41J 2/125* (2013.01); *B41J 2/04508* (2013.01); *B41J 2/04556* (2013.01); *B41J 3/36* (2013.01); *B41J 11/007* (2013.01); *B41J 11/0095* (2013.01); *B41J 29/02* (2013.01)

(58) Field of Classification Search

CPC ..... B41J 2/125; B41J 29/02; B41J 3/36; B41J 11/0095; B41J 2/04508; B41J 2/04556; B41J 11/007; B41J 2/01; B41J 11/008; B41J 29/38

See application file for complete search history.

(56) References Cited

U.S. PATENT DOCUMENTS

2002/0154186 A1* 10/2002 Matsumoto ..... B41J 11/0095 347/14

FOREIGN PATENT DOCUMENTS

| | | | |
|---|---|---|---|
| CN | 1755405 | A | 4/2006 |
| CN | 106311524 | A | 1/2017 |
| JP | H10-035034 | A | 2/1998 |
| JP | 2018-012964 | A | 1/2018 |

OTHER PUBLICATIONS

First Office Action dated Apr. 15, 2020 received in Chinese Patent Application No. CN 201910086290.9 together with an English language translation.

* cited by examiner

*Primary Examiner* — Bradley W Thies

(74) *Attorney, Agent, or Firm* — Scully Scott Murphy & Presser

(57) ABSTRACT

The application device comprises a sensor that detects movement of the application device on an application target, a camera that obtains a captured image that is an image of a surface of the application target and is captured during the movement of the application device, a head that applies ink, and a processor, wherein the processor specifies an ink application area based on the captured image of the surface of the application target that is captured by the camera in accordance with the movement that is detected by the sensor, and controls the head to apply ink to the ink application area in accordance with the movement.

12 Claims, 8 Drawing Sheets

APPLICATION DEVICE, INK APPLICATION METHOD, AND NON-TRANSITORY RECORDING MEDIUM

CROSS-REFERENCE TO RELATED APPLICATION

This application is based upon and claims the benefit of priority under 35 USC 119 of Japanese Patent Application No. 2018-012964 filed on Jan. 29, 2018, the entire disclosure of which, including the description, claims, drawings, and abstract, is incorporated herein by reference in its entirety.

FIELD

This application relates generally to an application device, an ink application method, and a non-transitory recording medium.

BACKGROUND

Printing devices that print a print-target image on a print medium in accordance with movement of the device on the print medium are known.

For example, patent literature (Unexamined Japanese Patent Application Kokai Publication No. H10-35034) discloses a manually-moved printing device that is manually scanned on a recording medium to print on the recording medium. Specifically, as the printing device disclosed in the patent literature is manually scanned on a recording medium by the user, the device ejects ink from the print head to the recording medium in accordance with the amount of movement of the device for printing. Furthermore, when the printing device disclosed in the Patent Literature is scanned in the opposite direction to the ordinary direction, the device decorates printed characters such as making the printed characters in bold or underlining the printed characters.

The printing device disclosed in the Patent Literature decorates the characters that are printed by its own device. On the other hand, there is a demand for application of ink based on a luminance distribution of characters and the like that preexist on the application target, which are not necessarily characters and the like that are printed by its own device.

SUMMARY

The present disclosure advantageously provides an application device, an ink application method, and a non-transitory recording medium that make it possible to apply ink based on a captured image of an application surface of an application target.

According to an embodiment of the present invention, the following is provided.

The application device according to the present disclosure is an application device, comprising:

a sensor that detects movement of the application device on an application target;

a camera that obtains a captured image that is an image of a surface of the application target and is captured during the movement of the application device;

a head that applies ink; and a processor, wherein the processor specifies an ink application area based on the captured image of the surface of the application target that is captured by the camera in accordance with the movement that is detected by the sensor, and controls the head to apply ink to the ink application area in accordance with the movement.

The ink application method according to the present disclosure is a method by an application device that comprises a head for applying ink, including:

detecting movement of the application device on an application target;

obtaining a captured image that is an image of a surface of the application target and is captured during the movement of the application device;

specifying an ink application area based on the captured image of the surface of the application target that is captured in accordance with the movement that is detected, and controlling the head to apply ink to the ink application area in accordance with the movement.

The non-transitory computer-readable recording medium according to the present disclosure is a recording medium on which a program is recorded, the program allowing a computer of an application device that comprises a head for applying ink to execute the processing of:

detecting movement of the application device on an application target;

obtaining a captured image that is an image of a surface of the application target and is captured during the movement of the application device;

specifying an ink application area based on the captured image of the surface of the application target that is captured by the camera in accordance with the movement that is detected by the sensor, and controlling the head to apply ink to the ink application area in accordance with the movement.

BRIEF DESCRIPTION OF THE DRAWINGS

A more complete understanding of this application can be obtained when the following detailed description is considered in conjunction with the following drawings, in which.

DETAILED DESCRIPTION

An embodiment of the present disclosure will be described below with reference to the drawings. Here, the same or corresponding parts are referred to by the same reference numbers.

Figure 1:
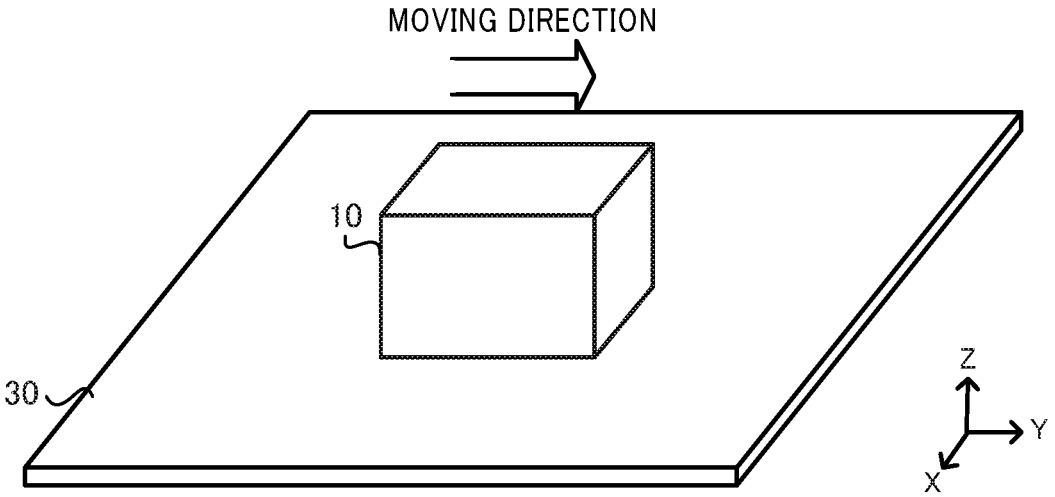
FIG. 1 is an illustration that shows an outline of an application device according to an embodiment of the present disclosure.

FIG. 1 shows an application device 10 according to an embodiment of the present disclosure. The application device 10 is a device capable of printing a print-target image of characters, symbols, figures, graphics, patterns, and the like on the surface of an application target 30 by applying ink in time with movement of its own device on the application target 30.

The application target 30 is, for example, print paper, labels, cardboard, or the like. The material of the application target 30 is not restricted to paper, and may be, for example, films, chemical fibers, resins, metals, or the like and can be anything as long as ink is allowed to adhere. The surface of the application target 30 to which ink is applied is not necessarily planar and may be curved, namely a surface more or less bulged or hollowed. Ink is an application material (paint) applied to the application target 30 for printing the print-target image. Here, ink is not necessarily liquid and may be solid or gelled. Moreover, ink may be dye ink, pigment ink, or the like and can be formed by any material as long as it is applicable.

The print-target image is formed on the application target 30 by applying ink while the user holds by hand and slidingly moves the application device 10 on the application target 30 in a prescribed moving direction as shown in FIG. 1. The application device 10 of such a system is called a manual-scan printing device, a handy printer, a direct printer, or the like.

Here, in FIG. 1, a X direction corresponds to the main scan direction of the application device 10 (the width direction), a Y direction corresponds to the sub scan direction of the application device 10 (the moving direction), and a Z direction corresponds to the direction perpendicular to the application surface of the application target 30, namely the vertical direction. The X, Y, and Z directions are orthogonal to each other. The same applies to the subsequent figures.

Figure 2:
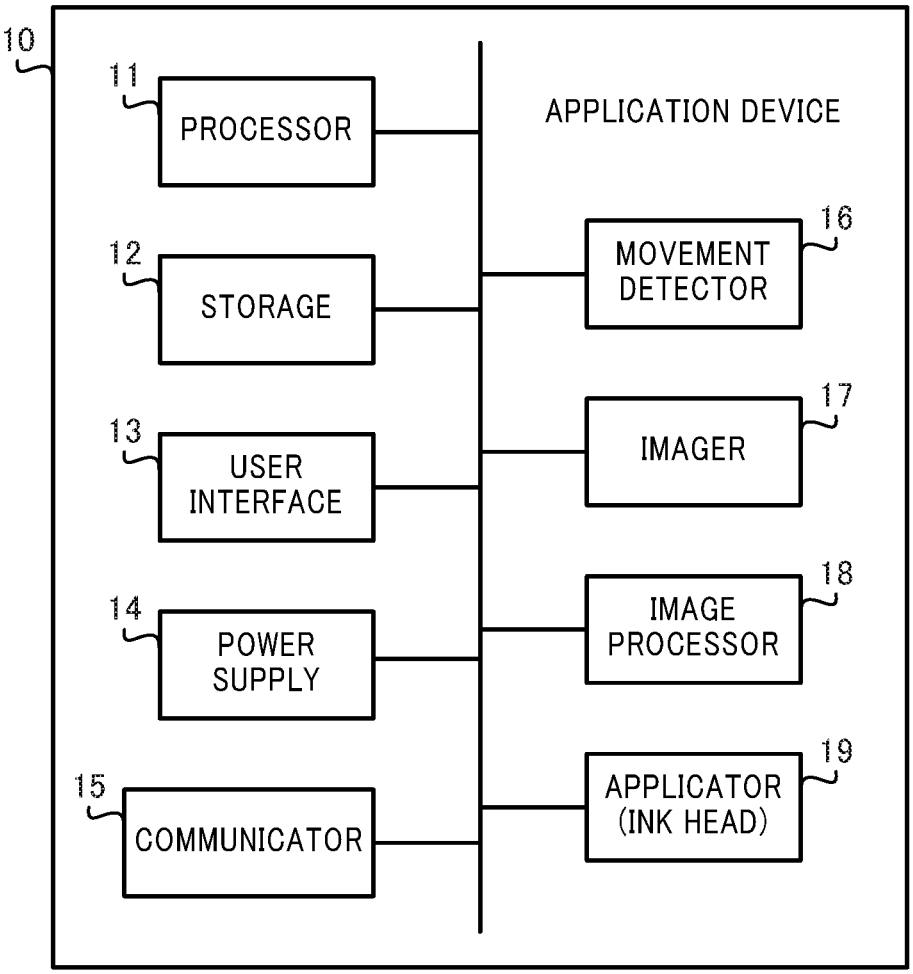
FIG. 2 is a block diagram that shows a hardware configuration of the application device according to the embodiment of the present disclosure.

As shown in FIG. 2, the application device 10 comprises a processor 11, a storage 12, a user interface 13, a power supply 14, a communicator 15, a movement detector 16, an imager 17, an image processor 18, and an ink head (applicator) 19.

The processor 11 comprises a central processing unit (CPU), a read only memory (ROM), and a random access memory (RAM). The CPU is, for example, a microprocessor or the like and a central arithmetic operation processor that executes various kinds of processing and arithmetic operations. In the processor 11, the CPU is connected to the parts of the application device 10 via a system bus and functions as control means for controlling the entire application device 10 while reading control programs that are stored in the ROM and using the RAM as the work memory. Moreover, the processor 11 comprises a clock that measures the time such as a real time clock (RTC).

The storage 12 is a nonvolatile memory such as a flash memory and a hard disc. The storage 12 stores programs and data that are used by the processor 11 to execute various kinds of processing. For example, the storage 12 saves display and print data such as characters, symbols, and emoji, and tables in which various print settings are stated. Moreover, the storage 12 stores data that are generated or acquired as a result of the processor 11 executing various kinds of processing.

The user interface 13 comprises an input receiver such as input keys, buttons, switches, a touch pad, and a touch panel, and a display such as a liquid crystal panel and a light emitting diode (LED). The user interface 13 receives various kinds of operation orders from the user via an inputter and transmits the received operation orders to the processor 11. Moreover, the user interface 13 acquires various kinds of information from the processor 11 and displays on the display images that indicate the acquired information.

The power supply 14 comprises a battery and a voltage detector and generates and supplies to the parts a power supply necessary for operations of the application device 10.

The communicator 15 comprises an interface for the application device 10 to communicate with an external device. The external device is, for example, a terminal device such as a personal computer, a tablet terminal, and a smartphone. The communicator 15 communicates with the external device via, for example, USB (universal serial bus), a local area network (LAN) such as wireless fidelity (Wi-Fi), Bluetooth (registered trademark), or the like. The communicator 15 acquires various kinds of data including print data from the external device via such wired or wireless communication under the control of the processor 11.

The movement detector 16 is provided in the lower part of the application device 10 and detects movement of the application device 10 while the application device 10 moves on the application target 30. Specifically, the movement detector 16 comprises a light emitter such as an LED that emits light toward the surface of the application target 30, and an optical sensor that reads light emitted by the light emitter and reflected on the surface of the application target 30. The movement detector 16 reads light emitted by the LED with the optical sensor and detects the amount of movement and the moving direction of the application device 10 based on change in the read light. The movement detector 16 functions as a sensor.

The imager 17 is a so-called camera and comprises a lens that collects light emitted by an object, an imaging element such as a charge coupled device (CCD) and a complementary metal oxide semiconductor (CMOS) that receives the collected light and acquires an image of the object, and an analog/digital (A/D) converter that converts data indicating a captured image sent by the imaging element as electric signals to digital data. While the application device 10 moves on the application target 30, the imager 17 captures images of the surface of the application target 30 and supplies to the processor 11 the captured images that are obtained through the imaging.

The image processor 18 comprises an image processing processor such as a digital signal processor (DSP) and a graphics processing unit (GPU) and a buffer memory that temporarily saves images to process, and processes captured images that are obtained through the imaging by the imager 17 under the control of the processor 11. For example, the image processor 18 executes recognition processing such as edge recognition, character recognition, and object recognition on the captured images using a known image recognition technique.

The applicator (ink head) 19 is an application mechanism (print mechanism) that executes printing by applying ink to the surface of the application target 30. The applicator 19 applies ink to the surface of the application target 30 in an inkjet system in which ink filled in an ink tank is atomized and directly blasted to the application target 30. The applicator 19 functions as a head.

As an example, the applicator 19 ejects ink in a thermal system. Specifically, in the applicator 19, multiple nozzles are arrayed in the main scan direction (the X direction) and the sub scan direction (the Y direction). Ink within the multiple nozzles is heated by a heater to create bubbles and the created bubbles cause the ink to be ejected (vertically downward) toward the application target 30 from each of the multiple nozzles. With this principle, the applicator 19 applies ink to the surface of the application target 30.

Figure 3:
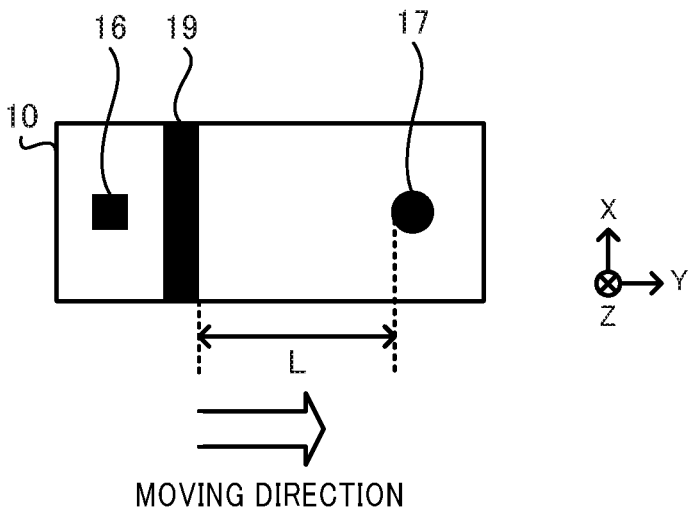
FIG. 3 is an illustration that schematically shows underside of the application device according to the embodiment of the present disclosure.
Figure 4:
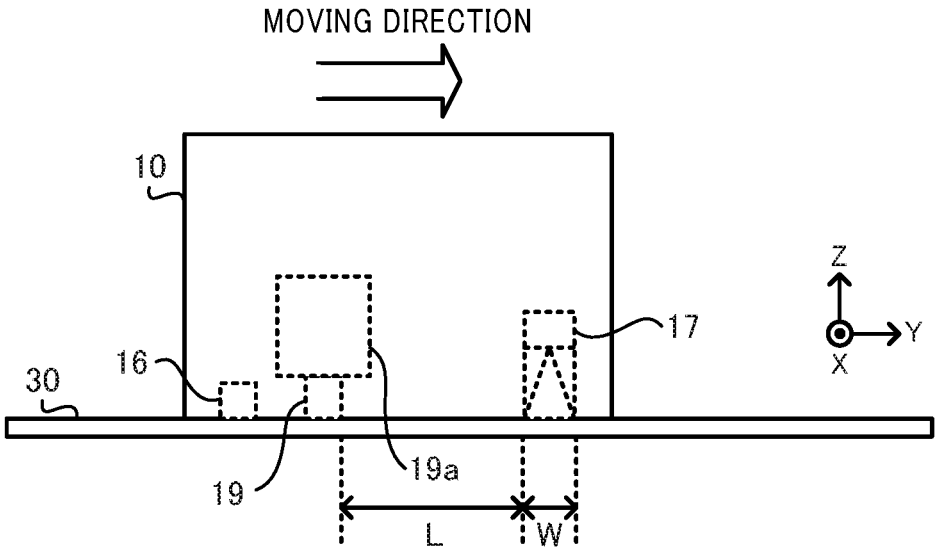
FIG. 4 is an illustration that shows the application device according to the embodiment of the present disclosure in a side view.

FIG. 3 shows the underside of the application device 10, namely the surface that faces the application target 30. Moreover, FIG. 4 shows the application device 10 moving on the application target 30 in a side view. Here, in FIG. 4, the positions in the application device 10 where the optical sensor of the movement detector 16, the lens of the imager 17, the nozzles of the applicator 19, and an ink tank 19*a* are provided are indicated by broken lines. As shown in FIGS. 3 and 4, the optical sensor of the movement detector 16, the lens of the imager 17, and the nozzles of the applicator 19 are provided to face down in the application device 10 so as to face the surface of the application target 30 on which the application device 10 is scanned.

Moreover, as shown in FIG. 4, the imager 17 is provided to the front in the moving direction (traveling direction) of the application device 10 and captures an image of an area of a width W in the moving direction. Then, the nozzles of the applicator 19 are provided behind the lens of the imager 17 by a distance L in the moving direction. In other words, the application device 10 moves in the direction from the position where the applicator 19 is provided to the position where the imager 17 is provided and the movement detector 16 detects the movement of the application device 10 on the application target 30 in such a moving direction.

With the above arrangement of the imager 17 and the applicator 19, the imager 17 captures an image of an area on the application target 30 to which ink is applied before the applicator 19 applies ink. The applicator 19 reaches the position where the imager 17 has captured an image after the application device 10 moves over the distance L since the imager 17 has captured an image of the position.

Figure 5:
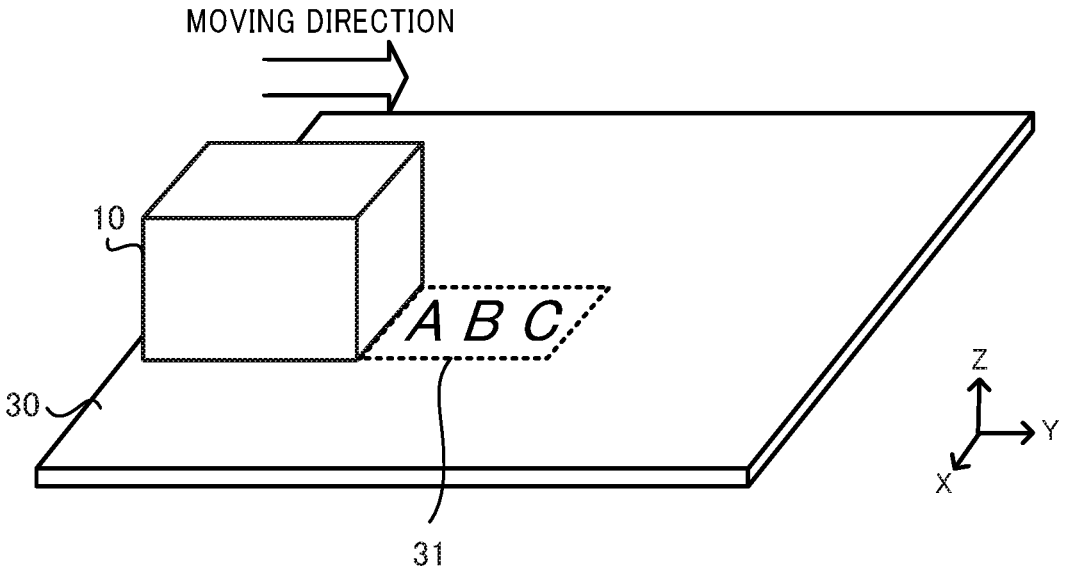
FIG. 5 is a first illustration that shows a case in which the application device according to the embodiment of the present disclosure applies ink.
Figure 6:
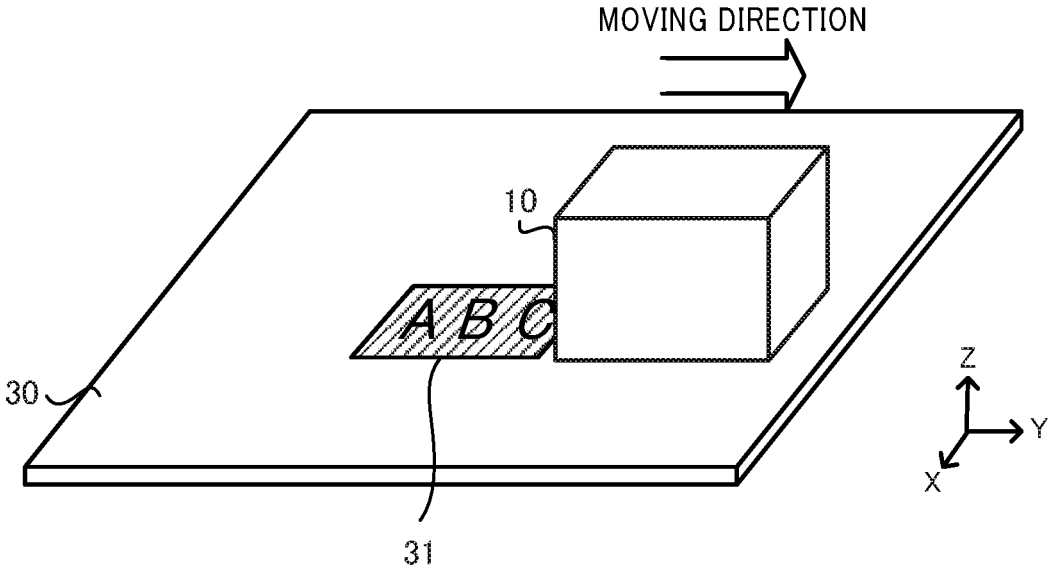
FIG. 6 is a second illustration that shows a case in which the application device according to the embodiment of the present disclosure applies ink.

FIGS. 5 and 6 show how the application device 10 applies ink to an ink application area 31 on the application target 30. While the application device 10 moves on the application target 30, the processor 11 captures images of the application target 30 with the imager 17 and specifies the ink application area 31. Here, the ink application area 31 is an area of the surface of the application target 30 that is an application target (the application surface) to which ink is applied by the application device 10. For example, as shown in FIG. 5, when the user desires to apply ink to the area in which characters "ABC" are depicted on the application target 30, the area that includes the characters "ABC" and is indicated by broken lines in FIG. 5 corresponds to the ink application area 31.

For applying ink to the ink application area 31, as shown in FIG. 5, the user places the application device 10 on the application target 30 in the manner that the end of the application device 10 to which the imager 17 is provided is aligned with the end of the ink application area 31. In this state, the user scans the application device 10 across the ink application area 31 and then the imager 17 captures images of the ink application area 31 and the applicator 19 applies ink to the ink application area 31.

The applicator 19 applies ink to the ink application area 31 based on the captured images of the ink application area 31 that are captured by the imager 17. Specifically, the applicator 19 applies ink to the specified ink application area 31 in a pattern based on the luminance distribution in the application target 30 of which images are captured by the imager 17 in accordance with the movement of the application device 10 detected by the movement detector 16.

Here, the luminance distribution in the ink application area 31 means the positional distribution of color shades in the ink application area 31. For example, when at least one character is depicted in the ink application area 31 as shown in FIG. 5, the character portion where characters are depicted is dark in color (namely, close to black) and therefore relatively low in brightness and the background portion other than the character portion in the ink application area 31 is light in color (namely, close to white) and therefore relatively high in brightness. The applicator 19 applies ink to the ink application area 31 in an application pattern determined based on such the luminance distribution within the ink application area 31.

In more detail, the applicator 19 apples ink to the background portion in the ink application area 31 to print a background image (1). Specifically, as shown in FIG. 6, the applicator 19 applies ink of a desired color (which is indicated by diagonal lines in FIG. 6) to the background portion around the preprinted characters "ABC" to print a background image. Alternatively, the applicator 19 may apply ink to the character portion of the characters "ABC" that are pre-depicted in the ink application area 31 to change the density or the color of the character portion, or may apply ink of the same color as the application target 30 to the character portion to erase the characters (2). Furthermore, the applicator 19 may apply ink to the border between the character portion and the background portion to enhance the outlines (3). The settings to or not to print a background image (1), to or not to change the density or the color of the character portion (2), or to or not to enhance the outlines (3) can be changed by the user through operation on the user interface 13. An applying processing by the application device 10 will be described below using a case of applying ink to the ink application area 31 in which the characters "ABC" are depicted to print a background image.

Figure 7:
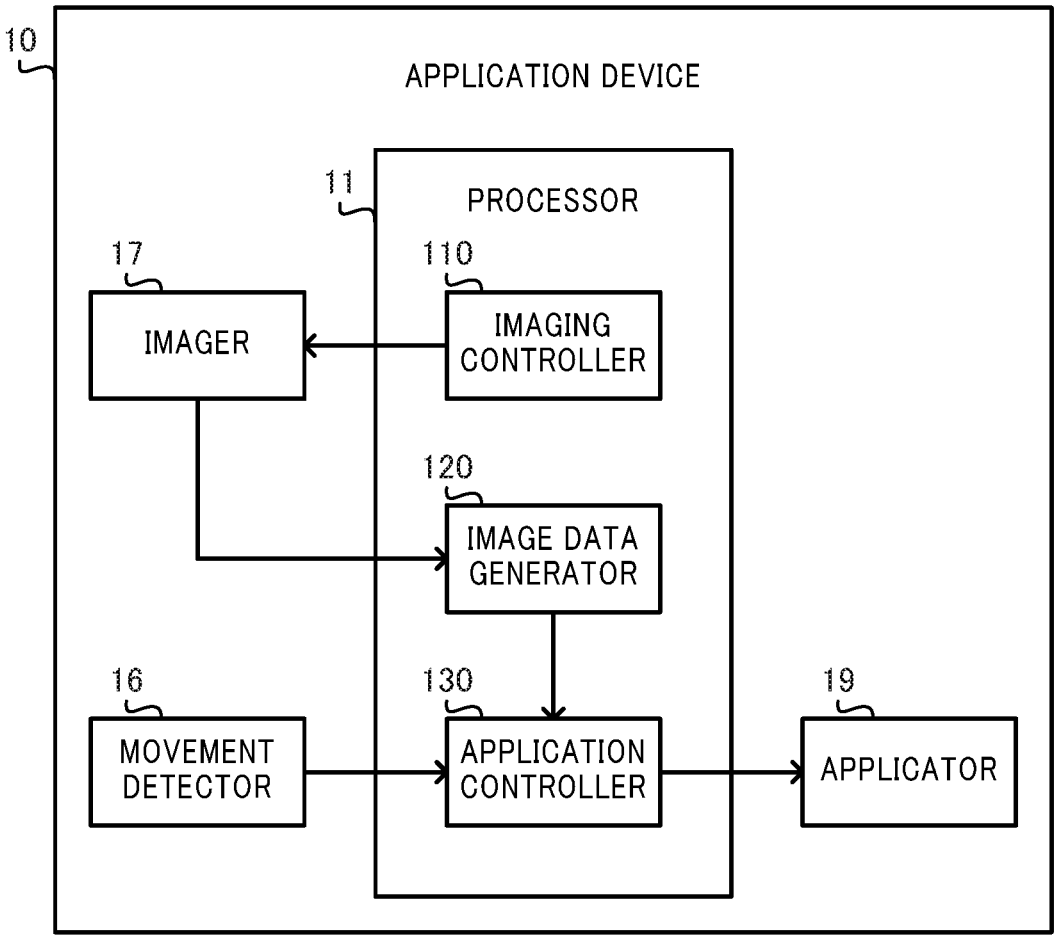
FIG. 7 is a block diagram that shows a functional configuration of the application device according to the embodiment of the present disclosure.

FIG. 7 shows the functional configuration of the application device 10. As shown in FIG. 7, the application device 10 functionally comprises an imaging controller 110, an image data generator 120, and an application controller 130. With the CPU reading onto the RAM and executing programs that are stored in the ROM, the processor 11 functions as these parts.

The imaging controller 110 controls imaging by the imager 17. Specifically, the imaging controller 110 makes the imager 17 capture an image with prescribed imaging timing while the application device 10 is scanned on the application target 30 by the user. A time for the imager 17 to capture an image comes each time a prescribed time has elapsed while the application device 10 is scanned on the application target 30. The prescribed time is preset, for example, to a value from several milliseconds to several hundred milliseconds or so. The imaging controller 110 is realized by the processor 11 cooperating with the imager 17.

The imager 17 repeatedly captures an image each time a prescribed time has elapsed under the control of the imaging controller 110 while the application device 10 moves on the application target 30. As a result, the imager 17 sequentially captures, while the application device 10 moves on the application target 30, images of multiple areas that are each a portion of the ink application area 31. In other words, the imaging range over which the imager 17 can capture an image at a time is limited to a range of the width W in the moving direction of the application device 10. Therefore, the imager 17 captures images of the ink application area 31 in partial areas instead of capturing an image of the entire ink application area 31 at a time.

Figure 8:
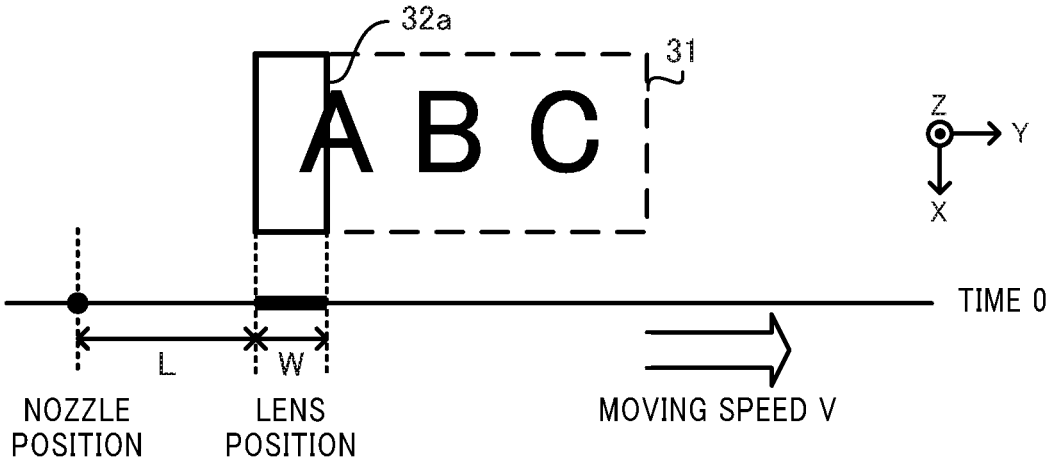
FIG. 8 is a first illustration that shows a case of the imaging and an applying processing by the application device according to the embodiment of the present disclosure.

Specifically, at a first imaging time when the elapsed time since the imaging start time is 0, as shown in FIG. 8, the lens of the imager 17 is situated near one end within the ink application area 31. At this point, the imager 17 captures an image of a first area 32*a* of the ink application area 31. The first area 32*a* is an area enclosed by solid lines in FIG. 8 and has the width W in the moving direction of the application device 10 (the Y direction) at one end within the ink application area 31. Here, at the imaging start time, the nozzles of the applicator 19 are situated outside the ink application area 31 and therefore application of ink by the applicator 19 does not start.

Figure 9:
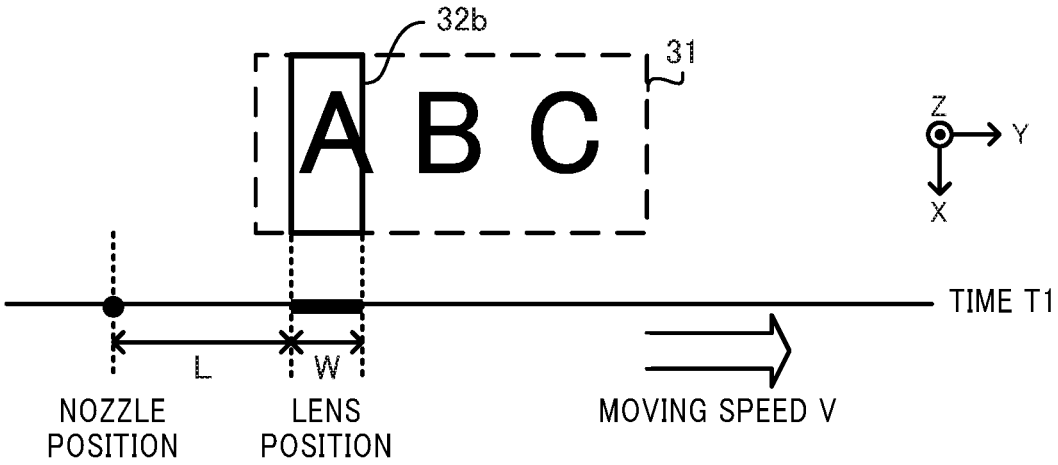
FIG. 9 is a second illustration that shows a case of imaging and the applying processing by the application device according to the embodiment of the present disclosure.

After capturing an image of the first area 32*a*, the application device 10 moves on the ink application area 31 from one end to the other. For example, provided that the moving speed of the application device 10 is presented by V, at a second imaging time when a time T1 has elapsed since the imaging start, the lens of the imager 17 moves over a distance (V×T1) from the imaging start position as shown in FIG. 9. At this point, the imager 17 captures an image of a second area 32*b* of the ink application area 31. The second area 32*b* is an area that has the width W like the first area 32*a* and is situated closer to the other end than the first area 32*a*.

Figure 10:
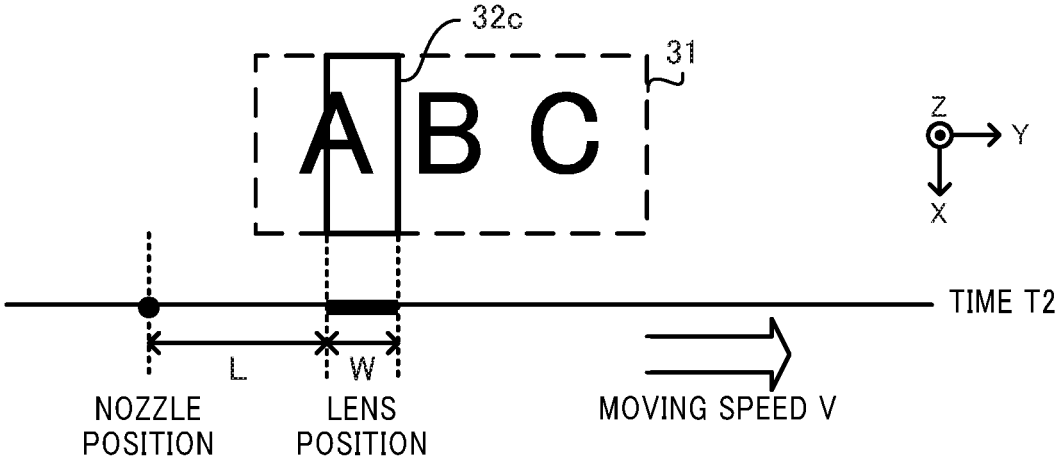
FIG. 10 is a third illustration that shows a case of the imaging and the applying processing by the application device according to the embodiment of the present disclosure.

As further shown in FIG. 10, at a third imaging time when a time T2 that is greater than the time T1 has elapsed since the imaging start, the imager 17 captures an image of a third area 32*c* of the ink application area 31. The third area 32*c* is an area that has the width W like the first area 32*a* and the second area 32*b* and is situated further closer to the other end than the second area 32*b*. Here, in the following explanation, the multiple areas 32*a*, 32*b*, 32*c*, . . . within the ink application area 31 are generically referred to as an area 32 when they are not distinguished from each other.

As described above, while the application device 10 moves on the ink application area 31, the imager 17 captures an image each time a prescribed imaging time comes, thereby capturing images of the multiple areas 32*a*, 32*b*, 32*c*, . . . of the width W within the ink application area 31 in sequence. The captured images that are captured by the imager 17 are associated with position information of the area 32 of which images are captured and then stored in the storage 12. The position information is stated based on the amount of movement of the application device 10 since the imaging start time detected by the movement detector 16.

Returning to FIG. 7, the image data generator 120 determines a pattern in which ink is applied to the ink application area 31 (the application pattern) based on the luminance distribution in the ink application area 31 of which images are captured by the imager 17 and generates image data indicating the determined application pattern. The application pattern is a mode of distribution of ink within the ink application area 31 and represented by positions within the ink application area 31 to which ink is applied and colors and densities of ink to apply to the positions. In other words, the image data generator 120 determines as the application pattern ink of what color is applied to what position within the ink application area 31 and at what density.

The image data generator 120 determines the application pattern based on the captured images of the ink application area 31 that are captured by the imager 17. Specifically, as the imager 17 captures an image of any of the multiple areas 32*a*, 32*b*, 32*c*, . . . , the image data generator 120 determines the application pattern based on the luminance distribution in the area 32 of which an image is captured, and generates image data.

Figure 11:
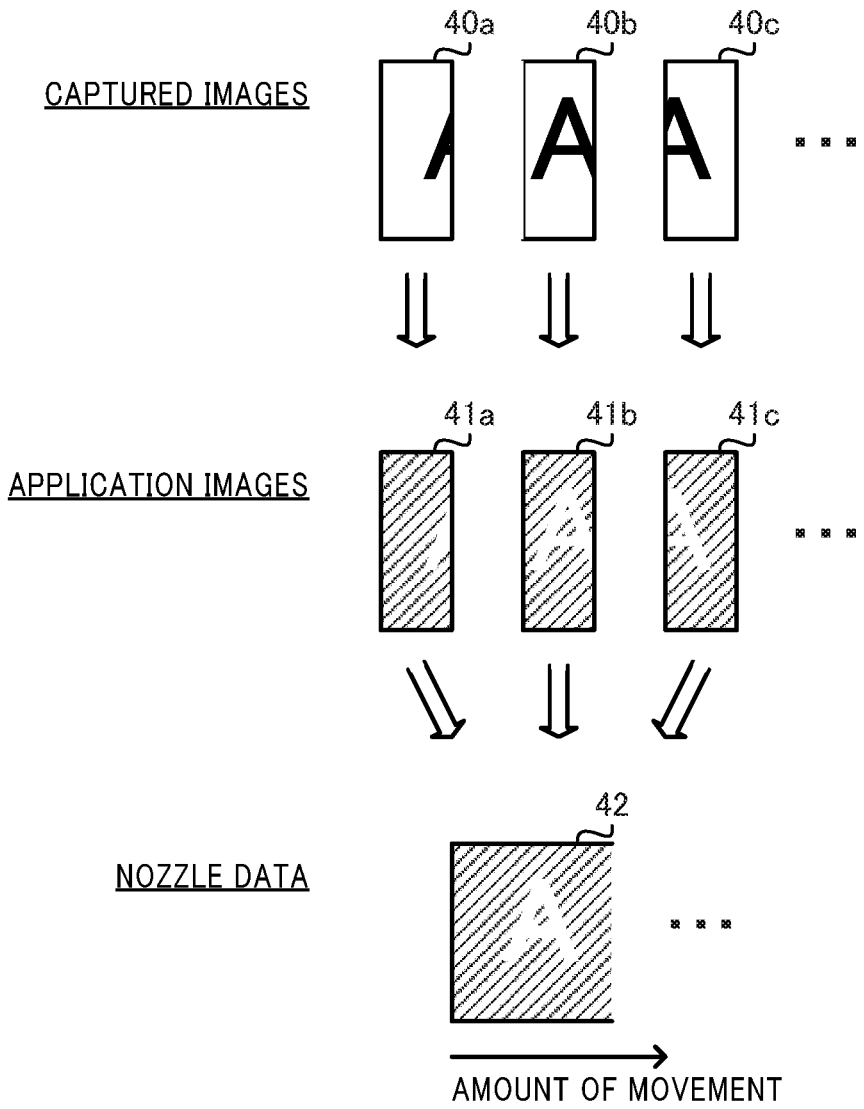
FIG. 11 is an illustration that shows a case of generating application images and nozzle data from captured images in the embodiment of the present disclosure.

FIG. 11 shows captured images 40*a*, 40*b*, 40*c*, . . . that are obtained as the imager 17 captures images of the areas 32*a*, 32*b*, 32*c*, . . . within the ink application area 31 in sequence. The image data generator 120 analyses such the captured images 40*a*, 40*b*, 40*c*, . . . in which an image of a portion within the ink application area 31 is captured according to a known image processing algorithm.

Specifically, the image data generator 120 calculates the brightness at each position within an image for each of the captured images 40*a*, 40*b*, 40*c*, . . . . Then, the image data generator 120 identifies a first area where the brightness is higher than a threshold (namely, relatively light portion) and a second area where the brightness is lower than the threshold (namely, relatively dark portion) in each of the captured images 40*a*, 40*b*, 40*c*, . . . . Consequently, the image data generator 120 identifies the first area where the brightness is higher than the threshold as the background portion and the second area where the brightness is lower than the threshold as the character portion.

Identifying the character portion and the background portion as described above, the image data generator 120 determines the application pattern based on the identification results. For example, for applying ink of a desired color to the background portion other than the character portion "ABC" in the ink application area 31, the image data generator 120 determines the application pattern to apply ink of a desired color to the background portion and apply no ink of any color to the character portion in each of the captured images 40*a*, 40*b*, 40*c*, . . . .

Determining the application pattern as described above, the image data generator 120 generates an image that indicates the determined application pattern (an application image). Specifically, as shown in FIG. 11, the image data generator 120 generates an application image 41*a* from the captured image 40*a* of the first area 32*a*, generates an application image 41*b* from the captured image 40*b* of the second area 32*b*, and generates an application image 41*c* from the captured image 40*c* of the third area 32*c*.

Here, in FIG. 11, for easier understanding, the color of ink applied to the background portion in the application images 41*a*, 41*b*, 41*c*, . . . is presented by diagonal lines. In the following explanation, the captured images 40*a*, 40*b*, 40*c*, . . . are generically referred to as a captured image 40 when they are not distinguished from each other. Similarly, the application images 41*a*, 41*b*, 41*c*, . . . are generically referred to as an application image 41 when they are not distinguished from each other.

As described above, each time the captured image 40 is obtained by the imager 17, the image data generator 120 generates, based on the captured image 40, the application image 41 that indicates a pattern of ink to apply to the area of which the captured image 40 is captured. Generating the application image 41, the image data generator 120 generates nozzle data 42 based on the generated application image 41. The nozzle data 42 are data for applying ink to the ink application area 31 from the nozzles of the applicator (ink head) 19 in the application pattern determined by the image data generator 120.

For example, as shown FIG. 11, when the application images 41*a*, 41*b*, 41*c*, . . . are generated from the captured images 40*a*, 40*b*, 40*c*, . . . , the image data generator 120 concatenates the application images 41*a*, 41*b*, 41*c*, . . . with the overlapped portions eliminated to generate the nozzle data 42. At this point, in order for the applicator 19 to be able to apply ink in time with the movement of the application device 10 on the ink application area 31, the image data generator 120 converts the position information along the Y direction in the application images 41*a*, 41*b*, 41*c*, . . . to the amount of movement of the application device 10 since the imaging start time to express the position information in the nozzle data 42. As just stated, the nozzle data 42 are image data that state the position of the nozzles of the applicator 19 that eject ink and the color and the density of ink in doing so in accordance with the amount of movement of the application device 10 on the application target 30.

Generating a new application image 41, the image data generator 120 generates nozzle data 42 with the newly generated application image 41. Then, the image data generator 120 repeatedly updates the existing nozzle data 42 with the newly generated application image 41 each time the application images 41*a*, 41*b*, 41*c*, . . . are generated in sequence. The image data generator 120 is realized by the processor 11 cooperating with the image processor 18. The image data generator 120 functions as image data generation means.

The application controller 130 controls application of ink by the applicator 19. Specifically, as movement of the application device 10 is detected by the movement detector 16, the application controller 130 outputs the content of the nozzle data 42 that are generated by the image data generator 120 to the applicator 19 in time with the detected movement. Then, the application controller 130 controls energized dots of the applicator 19 to eject ink from the nozzles of the applicator 19. As a result, printing is executed. The application controller 130 is realized by the processor 11 cooperating with the applicator 19. The application controller 130 functions as application control means.

The applicator 19 applies ink to the ink application area 31 in the pattern based on the captured image 40 of the ink application area 31 captured by the imager 17 in accordance with the movement of the application device 10 detected by the movement detector 16 under the control of the application controller 130. In more detail, with the imager 17 starting capturing images of the ink application area 31, as the application device 10 moves and thus the applicator 19 reaches an area of the ink application area 31 of which an image is captured by the imager 17, the applicator 19 applies ink to the ink application area 31 in accordance with the movement of the application device 10 detected by the movement detector 16.

Specifically, as shown in FIGS. 8 to 10, even if the imager 17 is situated above the ink application area 31, ink cannot be applied to the ink application area 31 unless the applicator 19 is situated in the ink application area 31. Therefore, the applicator 19 applies no ink from the nozzles until the position of the applicator 19 reaches the ink application area 31 after the imager 17 starts capturing images of the ink application area 31.

Subsequently, when the position of the applicator 19 reaches on the ink application area 31, the applicator 19 starts applying ink to the ink application area 31. Specifically, the applicator 19 starts applying ink to the ink application area 31 when the movement detector 16 detects movement over the distance L between the position where the applicator 19 is provided and the position where the imager 17 is provided from the position where the imager 17 has started capturing the ink application area 31.

Figure 12:
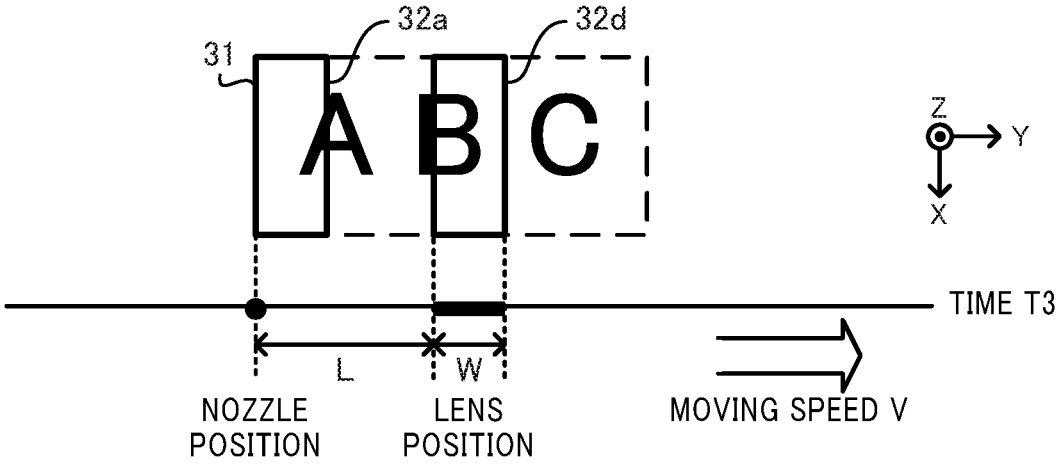
FIG. 12 is a fourth illustration that shows a case of the imaging and the applying processing by the application device according to the embodiment of the present disclosure.

For example, FIG. 12 shows the state in which the position of the nozzles of the applicator 19 has reached the first area 32*a* situated at one end of the ink application area 31 when a time T3 has elapsed since the imaging start. At this point, the imager 17 captures an image of an area 32*d* within the ink application area 31 that is different from the first area 32*a*. The area 32*d* is an area that is away from the first area 32*a* by the distance L in comparison of their ends on the same side. As the position of the nozzles reaches the first area 32*a* as shown in FIG. 12, the applicator 19 starts applying ink to the first area 32*a* according to the application image 41*a* generated based on the captured image 40*a* of the first area 32*a*. As a result, the application image 41*a* is printed in the first area 32*a*.

Figure 13:
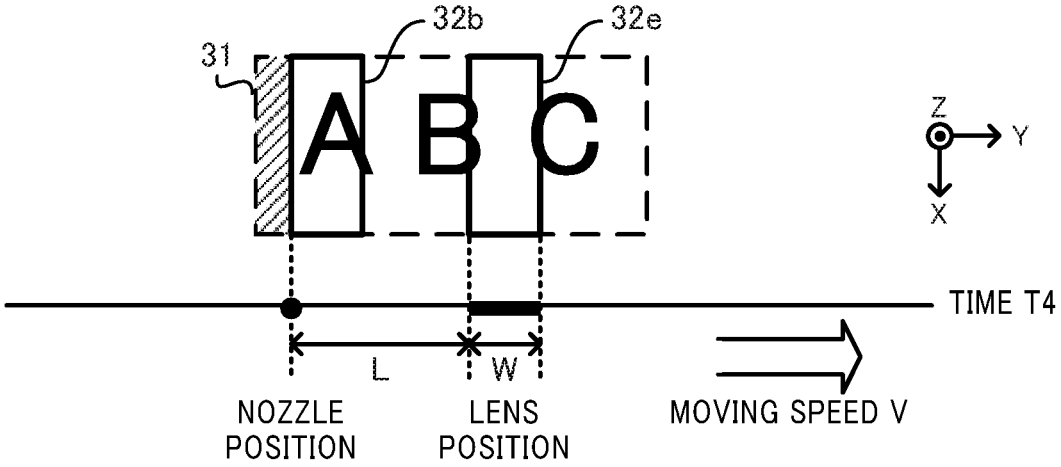
FIG. 13 is a fifth illustration that shows a case of the imaging and the applying processing by the application device according to the embodiment of the present disclosure.

Furthermore, FIG. 13 shows the state in which the position of the nozzles of the applicator 19 has reached the second area 32*b* when a time T4 that is greater than the time T3 has elapsed since the imaging start. At this point, the imager 17 captures an image of an area 32*e* within the ink application area 31 that is away from the second area 32*b* by the distance L. On the other hand, the applicator 19 has completed application of ink at the position within the ink application area 31 the nozzle has passed, namely to the part indicated by diagonal lines in FIG. 13. As the position of the nozzles reaches the second area 32*b* as shown in FIG. 13, the applicator 19 starts applying ink to the second area 32*b* according to the application image 41*b* generated based on the captured image 40*b* of the second area 32*b*. As a result, the application image 41*b* is printed in the second area 32*b*.

As described above, when the applicator 19 reaches each of the multiple areas 32*a*, 32*b*, 32*c*, . . . of which images are captured by the imager 17 by the movement of the application device 10, the applicator 19 applies ink to the area 32 the applicator 19 has reached in the pattern based on the luminance distribution in the area 32. For each of the multiple areas 32*a*, 32*b*, 32*c*, . . . , the image data generator 120 executes a processing of generating an application image 41 from the captured image 40 of the area 32 and a processing of generating nozzle data 42 from the generated application image 41 while the applicator 19 is reaching the area 32 of which an image is captured by the imager 17, namely while the application device 10 moves over the distance L. The applicator 19 applies ink to the ink application area 31 according to the nozzle data 42 that are generated by the image data generator 120 in accordance with the amount of movement of the application device 10 on the ink application area 31.

Figure 14:
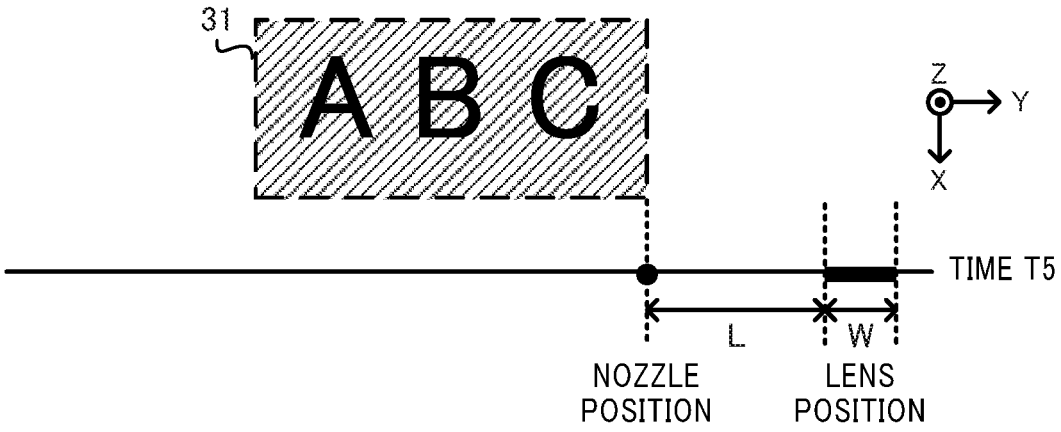
FIG. 14 is a sixth illustration that shows a case of the imaging and the applying processing by the application device according to the embodiment of the present disclosure.

Finally, as shown in FIG. 14, as the position of the nozzles of the applicator 19 reaches the other end of the ink application area 31 when a time T5 has elapsed since the imaging start, application of ink to the ink application area 31 is completed. As a result, in the case of FIG. 14, the background image is printed on the background portion to the characters "ABC" in the ink application area 31.

Figure 15:
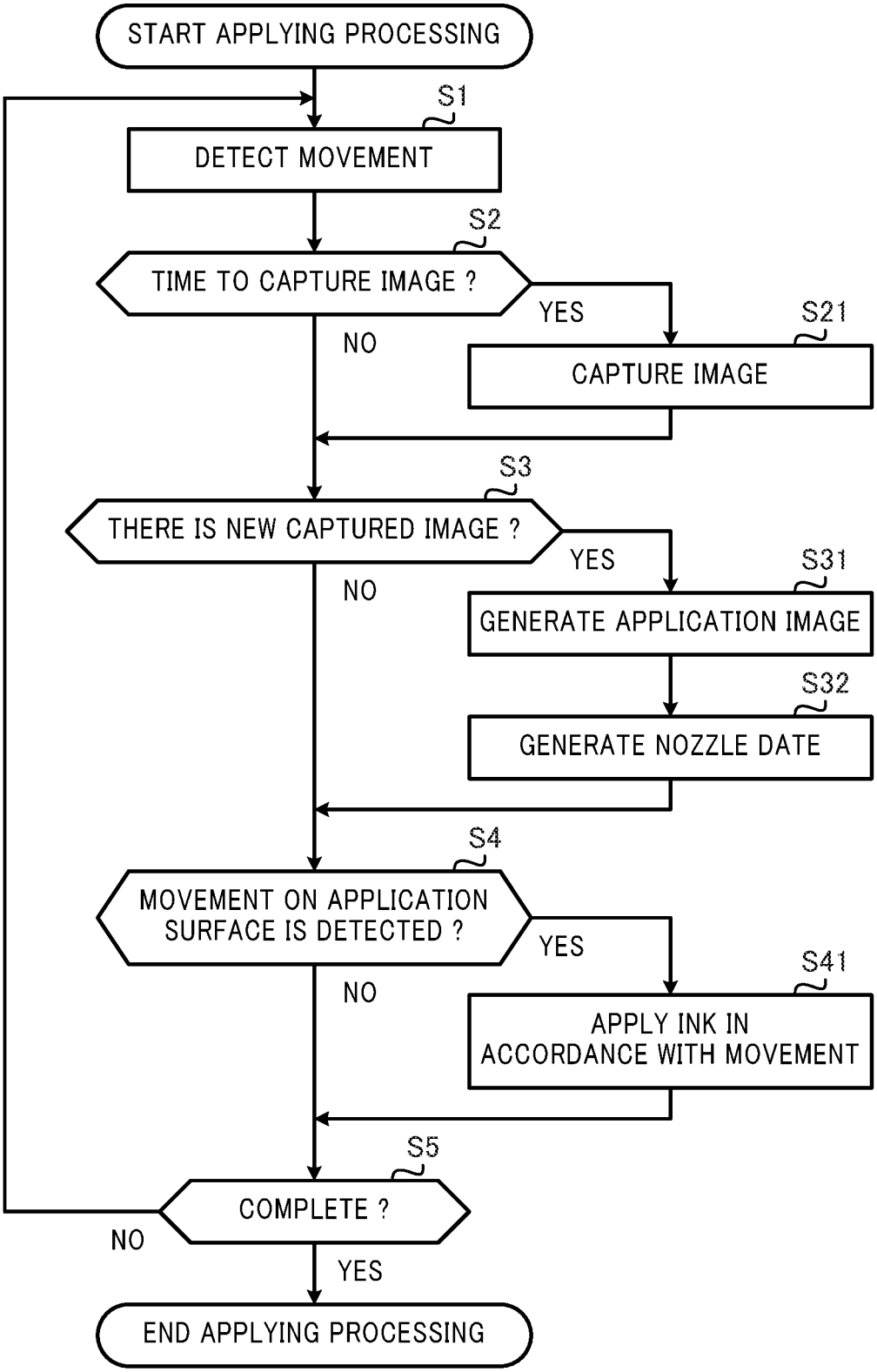
FIG. 15 is a flowchart that shows the process flow of the applying processing executed by the application device according to the embodiment of the present disclosure.

The process flow of the applying processing executed by the application device 10 that comprises the above configuration will be described with reference to FIG. 15.

When the user desires to apply ink to a desired ink application area 31 on the application target 30, the user operates the user interface 13 of the application device 10 to press down the print start button and places the application device 10 on the ink application area 31 with the position where the lens of the imager 17 is provided in alignment with the end of the ink application area 31. Then, the user scans the application device 10 in the direction from the position where the nozzles of the applicator 19 are provided to the position where the lens of the imager 17 is provided, namely in the +Y direction while keeping the underside of the application device 10 in contact with the application target 30. In such a state, the applying processing shown in FIG. 15 starts.

As the applying processing starts, the processor 11 detects movement of the application device 10 (Step S1). Specifically, as scanning of the application device 10 on the application target 30 starts, the processor 11 detects the amount of movement and the moving direction of the application device 10 on the application target 30 through the movement detector 16.

Detecting movement of the application device 10, first, the processor 11 determines whether a time to capture an image has come (Step S2). Specifically, a time to capture an image comes each time a prescribed time has elapsed while the application device 10 moves on the application target 30. Therefore, the processor 11 determines that a time to capture an image has come each time a prescribed time has elapsed since the application device 10 has started moving on the application target 30.

If a time to capture an image has come (Step S2; YES), the processor 11 functions as the imaging controller 110 to execute imaging (Step S21). Specifically, the processor 11 controls the imager 17 to capture an image of an area 32 of the width W that is a range over which the imager 17 can capture an image within the ink application area 31. On the other hand, if a time to capture an image has not come (Step S2; NO), the processor 11 skips the imaging of the Step S21.

Secondly, the processor 11 determines whether there is a new captured image 40 (Step S3). Specifically, the processor 11 determines whether a captured image 40 for which no application image 41 has been generated is newly obtained by capturing an image of any area 32 within the ink application area 31 in the Step S2.

If there is a new captured image 40 (Step S3; YES), the processor 11 functions as the image data generator 120 to generate an application image 41 based on the new captured image 40 (Step S31). For example, when one of the captured images 40*a*, 40*b*, 40*c*, . . . shown in FIG. 11 is obtained as a new captured image 40, the processor 11 determines the application pattern of ink to apply to the area of the ink application area 31 where the new captured image 40 is captured. Then, the processor 11 generates, for example, one of the application images 41*a*, 41*b*, 41*c*, . . . shown in FIG. 11 as the application image 41 that indicates the determined application pattern.

Generating the application image 41, the processor 11 further functions as the image data generator 120 to generate nozzle data 42 based on the generated application image 41 (Step S32). Specifically, the processor 11 generates, for example, the nozzle data 42 shown in FIG. 11 by concatenating the already generated application image 41 and the newly generated application image 41. As a result, the processor 11 converts data of the application image 41 to data for the applicator 19 to apply ink to the ink application area 31.

On the other hand, if determined that there is no new captured image 40 in the Step S3 (Step S3; NO), the processor 11 skips the processing of generating the application image 41 in the Step S31 and the processing of generating the nozzle data 42 in the Step S32.

Thirdly, the processor 11 determines whether movement of the application device 10 in the ink application area 31 on the application target 30 is detected by the movement detector 16 (Step S4). As shown in FIGS. 8 to 10, if movement in the ink application area 31 is not detected, namely before the position of the nozzles of the applicator 19 reaches the ink application area 31 since the start of capturing images of the ink application area 31, ink cannot be applied to the ink application area 31. Therefore, if movement of the application device 10 in the ink application area 31 is not detected (Step S4; NO), the processor 11 skips the processing of the Step S41 and does not apply ink to the ink application area 31.

On the other hand, if movement of the application device 10 in the ink application area 31 is detected (Step S4; YES), the processor 11 functions as the application controller 130 to apply ink in accordance with the movement of the application device 10 (Step S41). Specifically, the processor 11 applies ink to the ink application area 31 in the application pattern according to the nozzle data 42 that are generated in the Step S32 each time movement of the application device 10 on the ink application area 31 is detected by the movement detector 16.

For example, when the applicator 19 is situated in the first area 32*a* as shown in FIG. 12, the processor 11 applies ink to the first area 32*a* in an application pattern determined based on the captured image 40*a* of the first area 32*a*. Moreover, when the applicator 19 is situated in the second area 32*b* as shown in FIG. 13, the processor 11 applies ink to the second area 32*b* in an application pattern determined based on the captured image 40*b* of the second area 32*b*. In this way, the processor 11 applies ink to each area 32 within the ink application area 31 in accordance with the amount of movement of the application device 10 on the areas 32.

Subsequently, the processor 11 determines whether the applying processing on the ink application area 31 is complete (Step S5). Specifically, for example, when the user operates the user interface 13 to press down the end button, the processor 11 determines that the applying processing is complete. Alternatively, the processor 11 may determine that the applying processing is complete when the application device 10 is spaced from the application surface of the application target 30.

If the applying processing is not complete (Step S5; NO), the processor 11 returns the processing to the Step S1. Then, the processor 11 executes the processing of capturing an image each time a time to capture an image has come, executes the processing of generating the application image 41 and the nozzle data 42 each time a new captured image 40 is obtained, and executes the processing of applying ink each time movement of the application device 10 in the ink application area 31 is detected. The processor 11 repeats the above processing until application of ink to the ink application area 31 is complete. Finally, if the application of ink is complete (Step S5; YES), the applying processing shown in FIG. 15 ends.

As described above, the application device 10 according to this embodiment captures images of the ink application area 31 on the application target 30 that is an application target, and applies ink to the ink application area 31 in the pattern based on the luminance distribution in the ink application area 31 of which the images are captured in accordance with movement of its own device on the application target 30. As a result, the application device 10 according to this embodiment can apply ink based on the luminance distribution of characters and the like that preexist on the application target 30, which are not necessarily characters and the like that are printed by its own device.

Particularly, the application device 10 according to this embodiment comprises, in a single device, the capability of executing the processing of capturing images of the ink application area 31, the processing of generating the application image 41 and the nozzle data 42 based on the captured image 40, and the processing of applying ink. Then, the application device 10 according to this embodiment implements the processing of these three steps while the application device 10 moves on the ink application area 31 in one direction. Consequently, it is possible with a simple operation of the user holding and scanning the application device 10 on the ink application area 31 to apply ink with precise alignment with the positions of characters that are preprinted on the application target 30.

Modified Embodiments

An embodiment of the present disclosure is described above. However, the above embodiment is given by way of example and the applicable range of the present disclosure is not confined thereto. In other words, various applications are available to the embodiment of the present disclosure and any embodiment is included in the scope of the present disclosure.

For example, the above embodiment is described using a case in which the ink application area 31 is an area in which characters "ABC" are preprinted. However, in the present disclosure, the ink application area 31 is not restricted to such an area in which characters are printed. For example, as the ink application area 31, an area in which a symbol, a figure, or the like other than characters is preprinted may be selected or an area in which a pattern, a graphic, or the like is predepicted may be selected. Moreover, the ink application area 31 may be an area other than an area in which characters, a symbol, or a figure is printed or an area other than an area in which a pattern, a graphic, or the like is predepicted. Alternatively, as the ink application area 31, an area in which smear, stain, or the like is present on the application target 30 may be selected. As just stated, any area on the application target 30 may be set as the ink application area 31 as long as image data that indicate the luminance distribution in the area are obtainable through imaging of the imager 17.

Moreover, the above embodiment is described using a case in which the applicator 19 applies ink to the first area in the ink application area 31 where the brightness is higher than the threshold to print a background image on the background portion in the ink application area 31. However, in the present disclosure, the applicator 19 is not restricted to printing a background image and may apply ink to a portion of characters or the like in the ink application area 31 to change the color or the density of the characters or the like that preexists in the ink application area 31.

Specifically, the image data generator 120 determines an application pattern to apply ink of a desired color at a desired density to the second area in the ink application area 31 where the brightness is lower than the threshold. For example, for darkening characters or the like preprinted in the ink application area 31, the image data generator 120 determines an application pattern to apply, to the second area in the ink application area 31 that has a brightness lower than the threshold, ink of which the brightness is further lower than that brightness. On other hand, for lightening characters or the like preprinted in the ink application area 31 or for making less visible stain, smear, or the like that preexists in the ink application area 31, the image data generator 120 determines an application pattern to apply, to the second area in the ink application area 31 that has a brightness lower than the threshold, ink of which the brightness is higher than that brightness. Further, when making the second area inconspicuous, it is preferable to apply the ink whose brightness is higher than the brightness of the second area such that the brightness of the second area can approach the brightness of the first area that is in proximity to the second area. Then, the applicator 19 applies ink in the pattern determined by the image data generator 120.

Alternatively, the applicator 19 may enhance the outlines of characters by applying ink in the peripheral portions of characters in the ink application area 31. In such a case, the image data generator 120 determines an application pattern to apply ink of a desired color at a desired density to the boarder portion between the first area where the brightness is higher than the threshold and the second area where the brightness is lower than the threshold in the ink application area 31. Then, the applicator 19 applies ink in the pattern determined by the image data generator 120.

In the above embodiment, the application device 10 comprises the function of the image data generator 120 that generates the application images 41*a*, 41*b*, 41*c*, . . . and the nozzle data 42 based on the captured images 40*a*, 40*b*, 40*c*, . . . of the ink application area 31 that are captured by the imager 17. However, it may be possible in the present disclosure that the application device 10 does not comprise the function of the image data generator 120 and an external device of the application device 10 comprises the function of the image data generator 120. The external device is an information processing device such as a personal computer, a smartphone, and a tablet terminal connected to the application device 10 via wireless or wired communication or a server connected to the application device 10 via a wide area network such as the Internet.

When the application device 10 does not comprise the function of the image data generator 120, the application device 10 transmits data of the captured images 40*a*, 40*b*, 40*c*, . . . of the ink application area 31 that are captured by the imager 17 to the external device via the communicator 15. The external device generates, with the function of the image data generator 120 described in the above embodiment, the application images 41*a*, 41*b*, 41*c*, . . . and the nozzle data 42 based on the captured images 40*a*, 40*b*, 40*c*, . . . that are received from the application device 10 and transmits the generated nozzle data 42 to the application device 10. The application device 10 receives the nozzle data 42 from the external device via the communicator 15 and applies ink to the ink application area 31 according to the received nozzle data 42. Alternatively, the processing of generating the nozzle data 42 from the application images 41*a*, 41*b*, 41*c*, . . . may be executed by the application device 10, not by the external device. In such a case, the application device 10 receives the application images 41*a*, 41*b*, 41*c*, . . . from the external device, generates the nozzle data 42 from the received application images 41*a*, 41*b*, 41*c*, . . . , and applies ink to the ink application area 31 according to the generated nozzle data 42. As just stated, as the external device comprises at least part of the function of the image data generator 120, it is possible to reduce the amount of processing executed on the application device 10 and therefore simplify the configuration of the application device 10.

In the above embodiment, the imager 17 repeatedly captures images of multiple areas 32 within the ink application area 31 each time a prescribed time has elapsed while the application device 10 moves on the application target 30. However, in the present disclose, the imager 17 may repeatedly capture images of multiple areas 32 within the ink application area 31 each time movement over a prescribed distance is detected by the movement detector 16 while the application device 10 moves on the application target 30. In other words, timing of the imager 17 capturing images may be prescribed by the amount of movement of the application device 10 on the application target 30 instead of being prescribed by the elapse of time.

In such a case, the prescribed distance may be a distance that corresponds to the width W in the moving direction of the application device 10 on the application target 30 of an area of which an image the imager 17 can capture. In other words, the imager 17 may capture images of multiple areas 32 within the ink application area 31 each time movement over a distance that corresponds to the width W is detected by the movement detector 16 while the application device 10 moves on the application target 30. As just stated, as the imager 17 captures an image each time the application device 10 moves over a range over which the imager 17 can capture an image, it is possible to prevent the multiple areas 32 to capture images from overlapping with each other. Therefore, it is possible to efficiently acquire the captured images 40 within the ink application area 31 and reduce the amount of processing of the image data generator 120.

In the above embodiment, the application device 10 captures images of the ink application area 31 and applies ink to the ink application area 31 while moving on the application target 30 in a prescribed direction, specifically in the direction from the position where the applicator 19 is provided to the position where the imager 17 is provided in the application device 10 (the +Y direction). However, in the present disclosure, the application device 10 may execute the processing described in the above embodiment while moving on the application target 30 in a direction other than the prescribed direction. In other words, it may be possible to apply ink to an area at any position on the application target 30 in the pattern based on the luminance distribution in the area while the user scans the application device 10 in any direction on the XY plane.

Specifically, the movement detector 16 detects the amount of moving and the moving direction of the application device 10 while the application device 10 moves on the application target 30 in any direction. The imager 17 captures an image of an area on the application target 30 each time a prescribed time to capture an image has come while the application device 10 moves on the application target 30 in any direction. The captured image captured by the imager 17 is stored in the storage 12 in association with position information of the area of which an image is captured. Here, the position information is position information represented by two-dimensional coordinates on the XY plane and stated based on the amount of movement and the moving direction of the application device 10 since the imaging start, which are detected by the movement detector 16. When the position of the nozzles of the applicator 19 has reached an area of which an image is captured by the imager 17, the applicator 19 applies ink to the area in the pattern based on the luminance distribution in the area. As just stated, if the applicator 19 can apply ink when the position of the applicator 19 has reached an area on the application target 30 of which an image is captured by the imager 17, the application device 10 may be allowed to move on the application target 30 in any direction, not necessarily in the +Y direction.

In the above embodiment, the applicator 19 ejects ink from the applicator 19 in a thermal system. However, in the present disclosure, the applicator 19 may eject ink in another system, not necessarily in a thermal system. For example, the applicator 19 may eject ink in a piezoelectric system using a piezoelectric element to print a print-target image on the application target 30. Moreover, the applicator 19 may apply ink to the application target 30 in another system such as a heat transfer system, not necessarily in an inkjet system. Moreover, the shape of the application device 10 is not necessarily a quadratic prism shape as shown in FIG. 1 and can be any shape. Moreover, the imager 17 is not necessarily a camera and may be an optical sensor or the like that can detect the luminance distribution in the ink application area 31. In other words, the luminance distribution in the ink application area 31 is not necessarily detected by the imager 17 and may be detected by an optical sensor or the like while the application device 10 moves on the application target 30.

In the above embodiment, with the CPU executing programs that are stored in the ROM, the processor 11 functions as the parts of the imaging controller 110, the image data generator 120, and the application controller 130. However, it may be possible in the present disclosure that instead of the CPU, the processor 11 comprises, for example, dedicated hardware such as an application specific integrated circuit (ASIC), a field-programmable gate array (FPGA), and various kinds of control circuits and the dedicated hardware functions as the parts of the imaging controller 110, the image data generator 120, and the application controller 130. In such a case, the functions of the parts may each be realized by a separate piece of hardware or the functions of the parts may collectively be realized by a single piece of hardware. Moreover, it may be possible that among the functions of the parts, some are realized by dedicated hardware and others are realized by software or firmware.

Here, needless to say, an application device that preliminarily comprises the configuration for realizing the functions according to the present disclosure can be provided. Additionally, it is possible to make an existing information processing device or the like function as the application device according to the present disclosure by applying programs. In other words, it is possible to make an existing information processing device or the like function as the application device according to the present disclosure by applying programs for realizing the functional configurations of the application device 10 that are exemplified in the above embodiment in a manner that the CPU or the like that controls the existing information processing device or the like can execute the programs. Moreover, the ink application method according to the present disclosure can be implemented using the application device.

Moreover, such programs are applied by any method. The programs can be saved and applied, for example, on a non-transitory computer-readable recording medium such as a flexible disc, a compact disc (CD)-ROM, a digital versatile disc (DVD)-ROM, and a memory card. Furthermore, the programs can be superimposed on carrier waves and applied via a communication medium such as the Internet. For example, the programs may be posted and distributed on a bulletin board system (BBS) on a communication network. Then, the programs may be activated and executed in the same manner as other application programs under the control of an operating system (OS) to execute the above-described processing.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An application device, comprising:

a sensor that detects movement of the application device on an application target;

a camera that obtains a captured image that is an image of a surface of the application target and is captured during the movement of the application device;

a head that applies ink; and a processor, wherein the processor specifies an ink application area based on the captured image of the surface of the application target that is captured by the camera in accordance with the movement that is detected by the sensor, and controls the head to apply ink to the ink application area in accordance with the movement.

2. The application device according to claim 1, wherein with the camera starting capturing the captured image of the surface of the application target, the processor causes the head to apply ink to the ink application area when the head reaches the ink application area of the surface of the application target by the movement of the application device.

3. The application device according to claim 1, wherein the sensor detects the movement in a direction from a position where the head is provided to a position where the camera is provided in the application device, and the processor causes the head to start applying ink to the ink application area when, from a position where the captured image is captured by the camera, the movement over a distance that is from the position where the head is provided to the position where the camera is provided is detected by the sensor.

4. The application device according to claim 1, wherein the processor determines an application pattern based on a luminance distribution within the captured image captured by the camera and generates image data indicating the determined application pattern, and the head applies ink to the ink application area according to the image data generated by the processor in accordance with the movement that is detected by the sensor.

5. The application device according to claim 4, wherein the processor identifies a first area where brightness of the luminance distribution is higher than a threshold and a second area where the brightness is lower than the threshold in the captured image captured by the camera and determines the application pattern based on identification results.

6. The application device according to claim 5, wherein the processor determines the application pattern so as to apply ink to the first area where the brightness is higher than the threshold within the ink application area.

7. The application device according to claim 5, wherein the processor determines the application pattern so as to apply ink to the second area where the brightness is lower than the threshold within the ink application area.

8. The application device according to claim 7, wherein the head applies the ink whose brightness is higher than the brightness of the second area to the second area such that the brightness of the second area approaches the brightness of the first area that is in proximity to the second area.

9. The application device according to claim 5, wherein the processor determines the application pattern so as to apply ink to a border portion between the first area where the brightness is higher than the threshold and the second area where the brightness is lower than the threshold within the ink application area.

10. The application device according to claim 1, wherein the camera sequentially captures, while the application device moves on the application target, multiple areas, each area being a portion of the surface of the application target, and the head applies, based on a luminance distribution in the each area of the multiple areas, ink to the each area reached by the head, when the head reaches the each area captured by the camera by the movement of the application device.

11. The application device according to claim 10, wherein the camera repeatedly captures, while the application device moves on the application target, an image of each of the multiple areas each time a prescribed time elapses.

12. The application device according to claim 10, wherein the camera repeatedly captures, while the application device moves on the application target, an image of each of the multiple areas, each time the movement over a prescribed distance is detected by the sensor.

* * * * *